US006691621B2

(12) United States Patent
Pierrot et al.

(10) Patent No.: US 6,691,621 B2
(45) Date of Patent: Feb. 17, 2004

(54) IGNITION DEVICE FOR A PROPELLANT CHARGE

(75) Inventors: Jean-Francois Pierrot, Saint-Doulchard (FR); Jean-Luc Taillandier, Fussy (FR)

(73) Assignee: Giat Industries (FR)

( * ) Notice: Subject to any disclaimer, the term of this patent is extended or adjusted under 35 U.S.C. 154(b) by 0 days.

(21) Appl. No.: 10/187,623

(22) Filed: Jul. 3, 2002

(65) Prior Publication Data

US 2003/0005847 A1 Jan. 9, 2003

(30) Foreign Application Priority Data

Jul. 6, 2001 (FR) ..... 01 09053

(51) Int. Cl.[7] ..... C06C 5/06

(52) U.S. Cl. ..... 102/275.2; 102/275.4; 102/275.6; 102/275.11; 102/275.12; 102/202.14

(58) Field of Search ..... 102/275.2, 275.3, 102/275.4, 275.6, 275.8, 275.11, 275.12, 202.5, 202.9, 202.14

(56) References Cited

U.S. PATENT DOCUMENTS

| | | | | | |
|---|---|---|---|---|---|
| 3,326,127 | A | * | 6/1967 | Schimmel | |
| 4,292,896 | A | * | 10/1981 | Morrey et al. | 102/275.8 |
| 4,917,017 | A | * | 4/1990 | Beltz | 102/470 |
| 5,070,789 | A | * | 12/1991 | True et al. | 102/275.12 |
| 5,090,327 | A | | 2/1992 | Bilgeri | 102/430 |
| 5,144,893 | A | * | 9/1992 | Zeman et al. | 102/202.8 |
| 5,155,295 | A | | 10/1992 | Campoli | 102/430 |
| 5,179,250 | A | | 1/1993 | Campoli | 102/443 |
| 5,665,932 | A | * | 9/1997 | Viljoen et al. | 102/275.7 |
| 6,006,671 | A | * | 12/1999 | Yunan | 102/275.11 |
| 6,272,996 | B1 | * | 8/2001 | O'Brien et al. | 102/275.11 |

FOREIGN PATENT DOCUMENTS

| | | | | |
|---|---|---|---|---|
| CA | 1 200 718 | * | 2/1986 | 102/275.8 |
| DE | 334 511 | * | 3/1921 | 102/275.12 |
| FR | 2 794 855 | | 12/2000 | |

* cited by examiner

*Primary Examiner*—Stephen M. Johnson
(74) *Attorney, Agent, or Firm*—Parkhurst & Wendel, L.L.P.

(57) ABSTRACT

A propellant charge ignition device having one or more ignition means and incorporating one or more diffuser tube(s) extending through a part of the propellant charge. The structure permits a flame generated by the ignition means to be guided up to a propellant charge receiver zone. There is also disclosed a propellant charge incorporating one or more block(s) of agglomerated propellant powder, the block having at least one closed-ended ignition channel for receiving a diffuser tube of the propellant charge ignition device.

9 Claims, 5 Drawing Sheets

IGNITION DEVICE FOR A PROPELLANT CHARGE

BACKGROUND OF THE INVENTION

The technical scope of the invention is that of ignition devices for the propellant charge of a piece of ammunition.

Known ignition devices implement an igniting pyrotechnic composition or a squib.

It is known to ensure ignition spaced over substantially the full length of a propellant charge by using a squib that ignites a primer tube formed by a stack of black powder tablets.

Patent FR2593905 describes such a primer tube. However, present day cased ammunition generally has projectiles of great length whose rear part or tail piece is housed near to the ignition means. It is thus impossible to install sufficiently long primer tube in such ammunition.

To solve the problem of igniting such loads it is known to use flexible igniting means in the form of pyrotechnic cords whose igniting action is both axial and radial.

Patent EP344098 describes such an ignition device. This device has the main disadvantage of implementing a cord enclosing a pyrotechnic substance. This substance may be accidentally ignited, conducting to the inadvertent ignition of the propellant charge.

Such a risk is even greater during the assembly and integration phases of a propellant charge.

Moreover, attempts are being made at present to increase the density of propellant charges, and therefore improve their firing performances, by implementing agglomerated loads.

So as to improve the firing ballistics, the time and place of the ignition of such agglomerated blocks has to be controlled. This is made difficult by the implementation of classical ignition cords that ensure ignition over their full length.

Lastly, the coming years will see an improvement in firing performances through the implementation of plasma igniters. These igniters use electrical energy to increase the temperature and pressure of the propellant gases, and thus the initial velocity of the projectile.

Known plasma igniters (or torches) have a cylindrical structure similar to that of a classical primer tube and are difficult to associate with ammunition in which the projectile penetrates deeply inside the propellant charge.

SUMMARY OF THE INVENTION

The aim of the present invention is to propose an ignition device that overcomes such drawbacks.

Thus, the ignition device according to the invention may be associated with ammunition incorporating a projectile penetrating deeply inside the charge.

The ignition device according to the invention may be installed without risk in a charge and it allows the ignition of an agglomerated charge to be precisely controlled.

Thus, the invention relates to an ignition device for a propellant charge, comprising at least one ignition means, such device wherein it incorporates at least one inert diffuser tube extending through part of the propellant charge and allowing the flame generated by the ignition means to be guided up to a receiver zone of the propellant charge.

The diffuser tube will preferably be made of a flexible plastic material and may be of a thickness of between 0.7 and 1.5 mm.

The diffuser tube may have an internal diameter of between 3 and 6 mm.

According to a particular embodiment, the ignition means can be electrical means generating a plasma (plasma torch).

Advantageously, the device may incorporate an expansion chamber placed between the plasma igniter outlet and the diffuser tube or tubes.

The invention also relates to a propellant charge incorporating such an ignition device.

This propellant charge will incorporate at least one block of agglomerated propellant powder, such block having at least one closed-ended ignition channel intended to receive a diffuser tube According to a particular embodiment, the charge may incorporate at least two blocks of agglomerated propellant powder stacked on top of one another, a first block at least having an open-ended connecting channel intended to receive a diffuser tube through said first block coming to lodge in an ignition channel made in a second block.

Each block may thus incorporate three closed-ended ignition channels evenly spaced angularly and each intended to receive a diffuser tube.

According to another embodiment, the charge comprises at least three agglomerated blocks that each incorporate three closed-ended ignition channels evenly spaced angularly and intended to receive a diffuser tube, the block nearest to the igniter also incorporating six open-ended connecting channels and an intermediate block incorporating three open-ended connecting channels.

BRIEF DESCRIPTION OF THE DRAWINGS

The invention will become more apparent after reading the following description of the different embodiments, such description made with reference to the appended drawings in which.

DETAILED DESCRIPTION OF PREFERRED EMBODIMENTS

Figure 1:
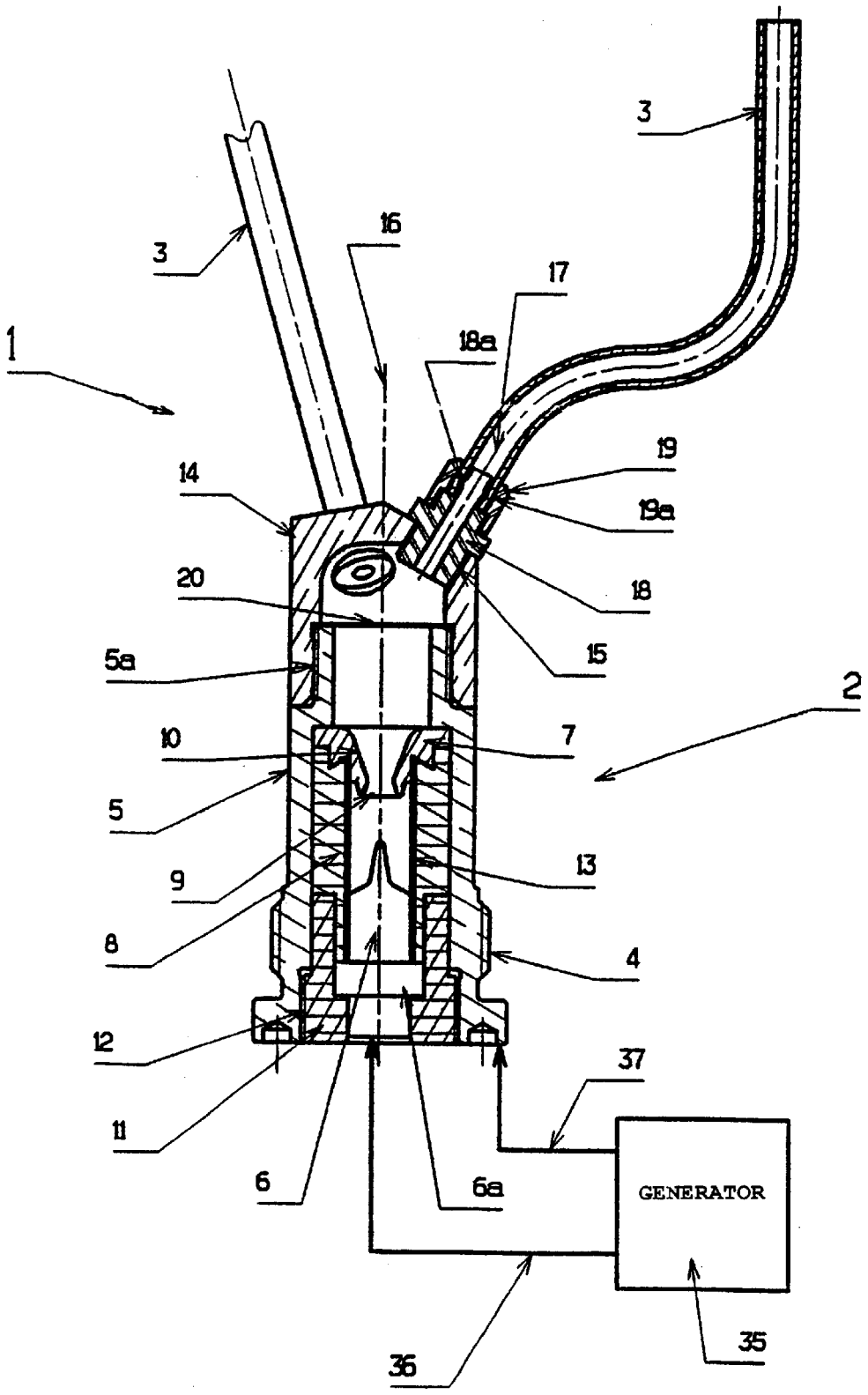
FIG. 1 shows a longitudinal section of an ignition device according to a first embodiment of the invention.
Figure 2:
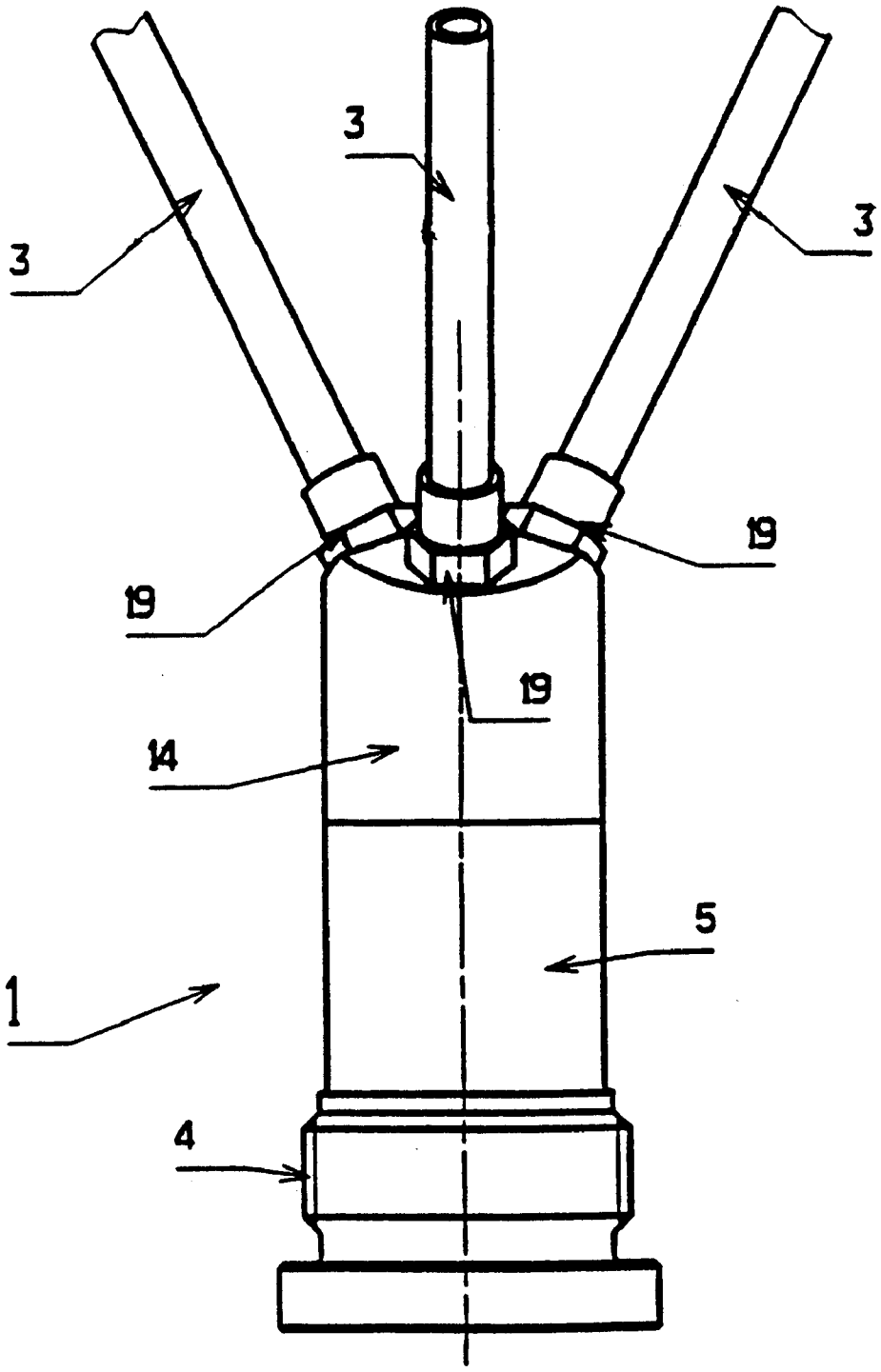
FIG. 2 is an external view of this first embodiment of the invention.

FIGS. 1 and 2 thus show an ignition device 1 according to a first embodiment of the invention.

This device comprises ignition means 2 to which three diffuser tubes 3 are connected.

The device is shown here alone. The ignition means 2 are intended to be made integral with the base of a piece of ammunition (not shown). The body 5 of the ignition means is fitted in this aim with threading 4 intended to cooperate with female threading on the base.

Here, the ignition means are a plasma generator incorporating two electrodes 6 and 7 separated by a cylindrical insulating case 8 made of an ablatable plastic material, that is a material able to generate light gases through the action of a plasma. The case 8 may, for example, be made of polyethylene, polyoxymethylene or polytetrafluorethylene. The case 8 may also be made of an energetic material such as nitro-cellulose.

Such a case is generally called a capillary tube in known plasma igniters.

Electrodes 6 and 7 are made, for example, of a copper-based alloy. They are intended to be connected to an electric generator 35 by means of electrical connections 36 and 37. A first connection 36 is in electrical contact by appropriate means (for example, a spring touch needle, not shown) with the rear electrode 6. A second connection 37 is in electrical contact with the metallic body 5, for example by a spring touch needle bearing on a rear part of the body or else on the metallic base of the ammunition (not shown).

The generator 35 is designed to be able to deliver an energy of 1 Kilojoules to 1 Mega Joule in the form of voltage pluses of 1000 volts to 20 kilo volts. Such a generator is classical and comprises, for example, capacitance resistors, an inductance resistor, thyristors and a stabilized power source.

The rear electrode 6 is globally cylindrical and of the same axis as the body 5. It extends inside the case 8.

The front electrode 7 is tubular and its axial piercing has a nozzle-shaped profile incorporating a convergent conical profile 9 open on the rear electrode 7 side followed by a divergent conical profile 10. This nozzle allows the thermal losses from the plasma generated by the torch to be reduced. Indeed, the nozzle allows the gases located on the periphery to be brought back into the axis of the torch. These gases are thus heated by the plasma.

The front electrode 7 is electrically connected to the body 5 of the ignition means by tight fitting of its cylindrical external surface.

The stack formed by the two electrodes and the case 8 is held in place by a nut 11, screwed into a female threading 12 in the body 5 and which is applied onto a shoulder 6*a* of the rear electrode 6. The nut 11 is made of an insulating material.

A priming fuse 13 is placed between electrodes 6 and 7. It is in the shape of a tube made of a conductive material associated with at least one energetic material or material able to react with the conductive material.

By energetic material, we mean one able to supply chemical energy in the form of a flame when it is ignited by the Joule effect generated by the passage of the current through the conductive material to which it is closely associated.

By reactive material or material able to react with the conductive material, we mean a material that is inert when isolated but which is able to chemically react with the conductive material when the latter is heated by the Joule effect. Chemical energy is thus supplied by this reaction in the form of a flame.

The conductive material may be constituted by carbon or else by a metal such as copper, aluminum, silver, tungsten or magnesium.

A tube 13 made be made, for example, of a layer of chlorofluoroethylene copolymer (known under the trade name Viton) deposited on a layer of aluminum.

Such a type of plasma igniter using an energetic fuse is described in patent application FR00/04734 and will not be described here in further detail. Reference may also be made to patent application FR00/04735 that describes a plasma igniter with no priming fuse but incorporating a front electrode in the form of a nozzle.

Other examples of plasma igniters, notably with a fuse wire, are described in patents FR2754969 and FR2768810.

According to the invention, the ignition device comprises diffuser tubes 3 integral with the ignition means.

These diffuser tubes are made of a plastic material and are totally inert since they enclose no pyrotechnic composition.

The tubes are made integral with the ignition means by a connection sleeve 14 screwed onto a front threaded part 5*a* of the body 5 of the ignition means 2. This sleeve 14 has three female threadings 15 evenly spaced angularly and whose axes 17 form an angle with the axis 16 of the body 5 of the ignition means 2. Each female threading 15 receives a tubular screw 18 onto which a locking nut 19 is fastened.

The tubular screw 18 has a conical seat 18*a* that co-operates with a matching conical seat 19*a* on the nut to ensure the pinching, and thus the immobilization and sealing, of the diffuser tube 3.

Said tube is made of a flexible plastic material, for example polyamide, polyethylene or polyolefin. The thickness of the diffuser tube is between 0.7 and 1.5 mm, and its internal diameter is between 3 and 6 mm.

The screw 18 and the nut 19 thereby constitute means to make the diffuser tube 3 integral with the connecting sleeve 14, and thus with the ignition means 2.

Each diffuser tube 3 is intended to extend through part of the propellant charge (not shown). It allows the flame generated by the ignition means to be directed up to a propellant charge reception zone (not shown here). For example, diffuser tubes may be fastened onto the inner wall of a case of the ammunition.

Thus, thanks to the invention, the flame produced by the ignition means 2 is precisely conducted to a required point in the charge without the risk of a radial ignition effect through the diffuser tube.

The thermal inertia of the material used is enough for the flame to be thus conducted without destroying the diffuser tube and this even when the ignition means generate a plasma (temperature of approximately 5000 K).

The diffuser tube will be destroyed later by the temperature and pressure of the gases developed during the combustion of the whole propellant charge.

The sleeve 14 and the body 5 of the ignition means 2 delimit an expansion chamber 20 that is placed between the plasma igniter 2 outlet and the diffuser tubes 3. This expansion chamber allows the pressure of the plasma as well as its chemical composition to be homogenized.

By way of a variant it is naturally possible to vary the number of diffuser tubes connected to the ignition means.

It is also possible with these diffuser tubes to associate classical ignition means implementing a pyrotechnic composition with no plasma generation. In this case, the body 5 of the ignition means will enclose a flame-generating pyrotechnic composition. It may comprise a flame-intensifying relay associated with an electrically initiated squib.

Figure 3:
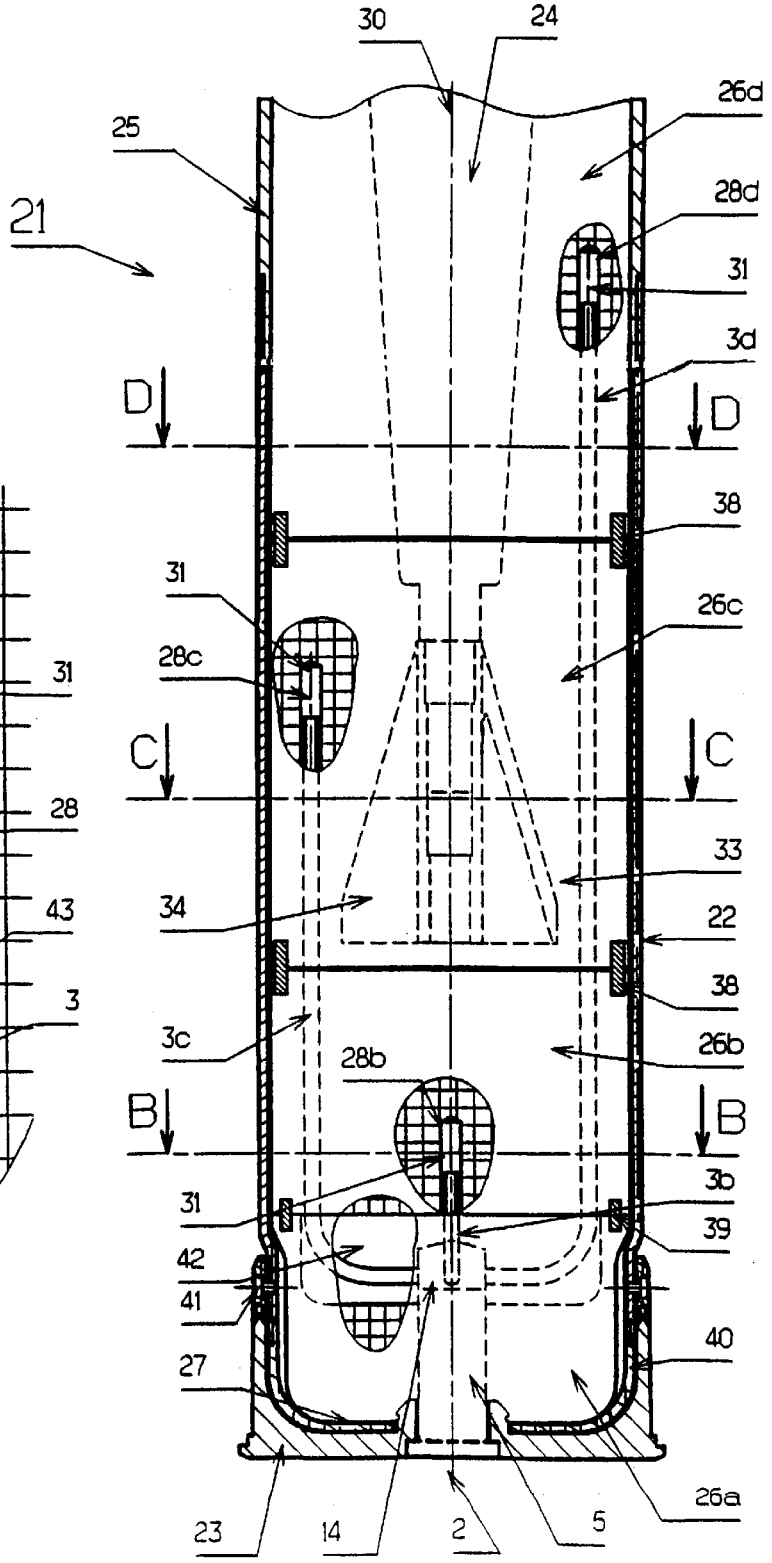
FIG. 3 shows a partial longitudinal section of a piece of ammunition equipped with an ignition device according to a second embodiment of the invention and enclosing a propellant charge according to the invention.

FIG. 3 shows a partial longitudinal section of a piece of ammunition 21 fitted with an ignition device according to a second embodiment of the invention.

This embodiment essentially differs from the first one in that it comprises nine diffuser tubes 3, distributed in three sets, the tubes of the different sets being of different lengths (here, for the sake of visibility on the Figure, only a few tubes have been shown).

The ammunition 21 comprises a case 22 made of a combustible material, for example cardboard impregnated with nitro-cellulose, such case having a base to which an obturator 23 is fastened that carries the ignition means 2 and on its inner surface receives a bowl 40 made of a plastic material. The obturator base is fastened to the case 22 by radial rivets 41 evenly spaced angularly.

The ammunition 21 also comprises a projectile 24 (here a fin-stabilized sub-calibred projectile) that is fastened to the case 22 by a linking part 25 made, for example, of a plastic material. The case 22 is fastened to the linking part 25 by rivets (not shown).

This ammunition is not described in detail. Reference may advantageously be made to patent FR2620214, which describes such a linking ring.

In accordance with the invention, the propellant charge of this ammunition incorporates at least one block of agglomerated propellant powder (here there are four blocks 26*a*, 26*b*, 26*c*, 26*d*).

The blocks are made, for example, by uniaxial, hot (around 80° C.) compression (around 30 MPa) of propellant powder composed of grains impregnated with a thermoplastic or energetic binder. The compression will be carried out in a mould whose shape produces the geometry required for the block.

The rear block 26*a* presses on the bowl 40 placed in the base 23. This block incorporates a recess 42 that allows the radial deployment of the different diffuser tubes 3 around the ignition means 2.

The three other agglomerated blocks 26*b*, 26*c* and 26*d* have three closed-ended ignition channels 28, evenly spaced angularly and intended to each receive a diffuser tube 3. Block 26*b* thus has three ignition channels 28*b*, block 26*c* has three ignition channels 28*c* and block 26*d* has three ignition channels 28*d*.

Figure 7:
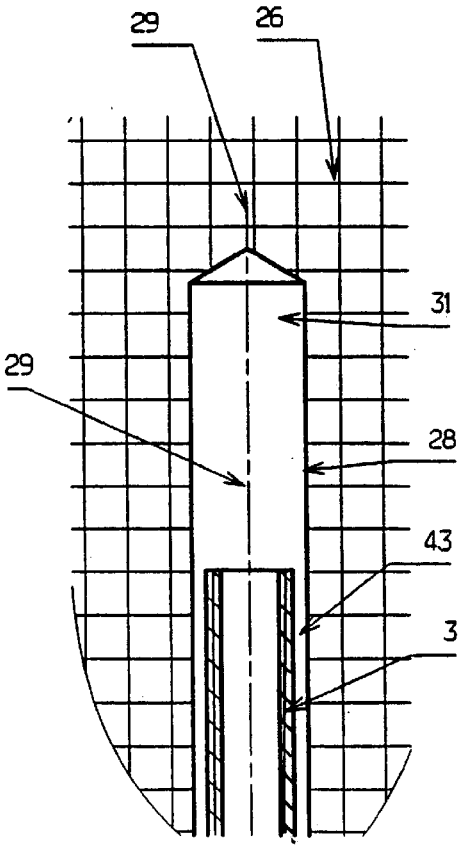
FIG. 7 is a detailed view of the propellant charge according to the invention.

FIG. 7 shows an enlarged view of the closed end of an ignition channel 28. This channel has an axis 29 that is parallel to the axis 30 of the ammunition 21 and it receives a diffuser tube 3.

The tube 3 is not fastened to the block 26. A few mm of play 43 remain between the tube 3 and the channel 28. The diffuser tube 3 does not extend to the bottom of the ignition channel 28. An ignition chamber 31 thus remains in which the flame conducted by the diffuser tube 3 may act to ensure the localized ignition (but spread over three zones) of the propellant block 26.

The location of the ignition of the different blocks is thus perfectly controlled. Thanks to the invention, each block 26 simultaneously receives the flame supplied by the igniter 2 at its three ignition zones. This results in the improved control of the pressure present in the weapon chamber and better ballistic performances.

Figure 4:
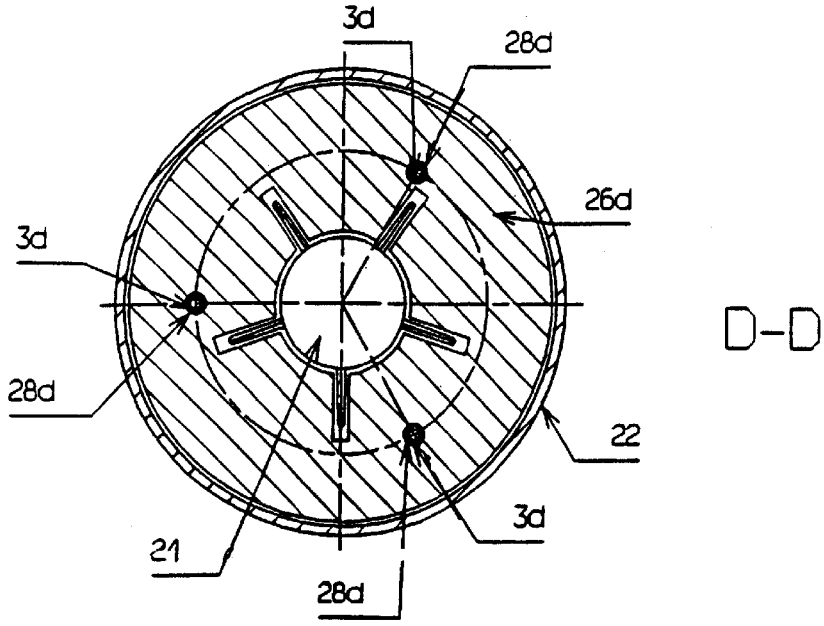
FIGS. 4, 5 and 6 are cross sections of this ammunition, such sections made respectively along planes DD, CC and AA marked out in FIG. 3.
Figure 5:
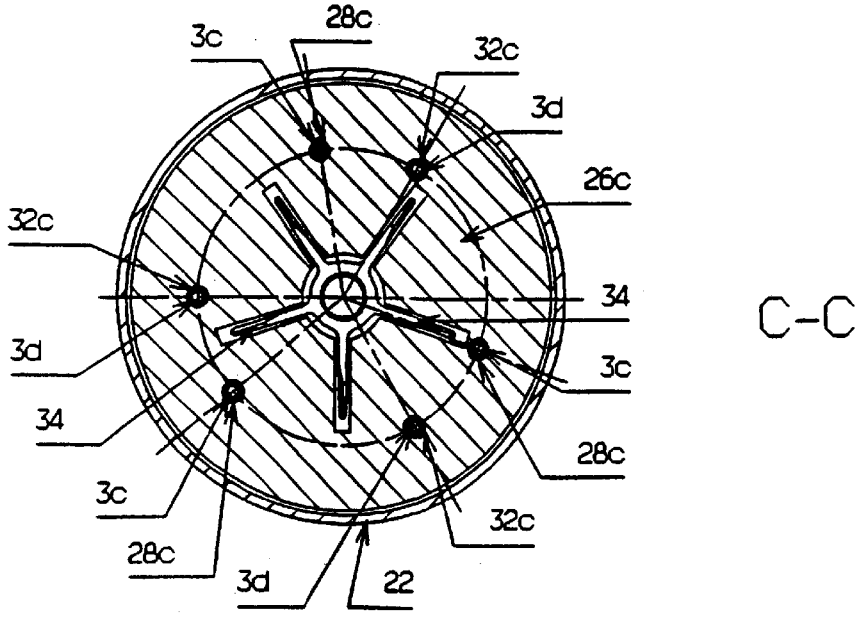
Figure 6:
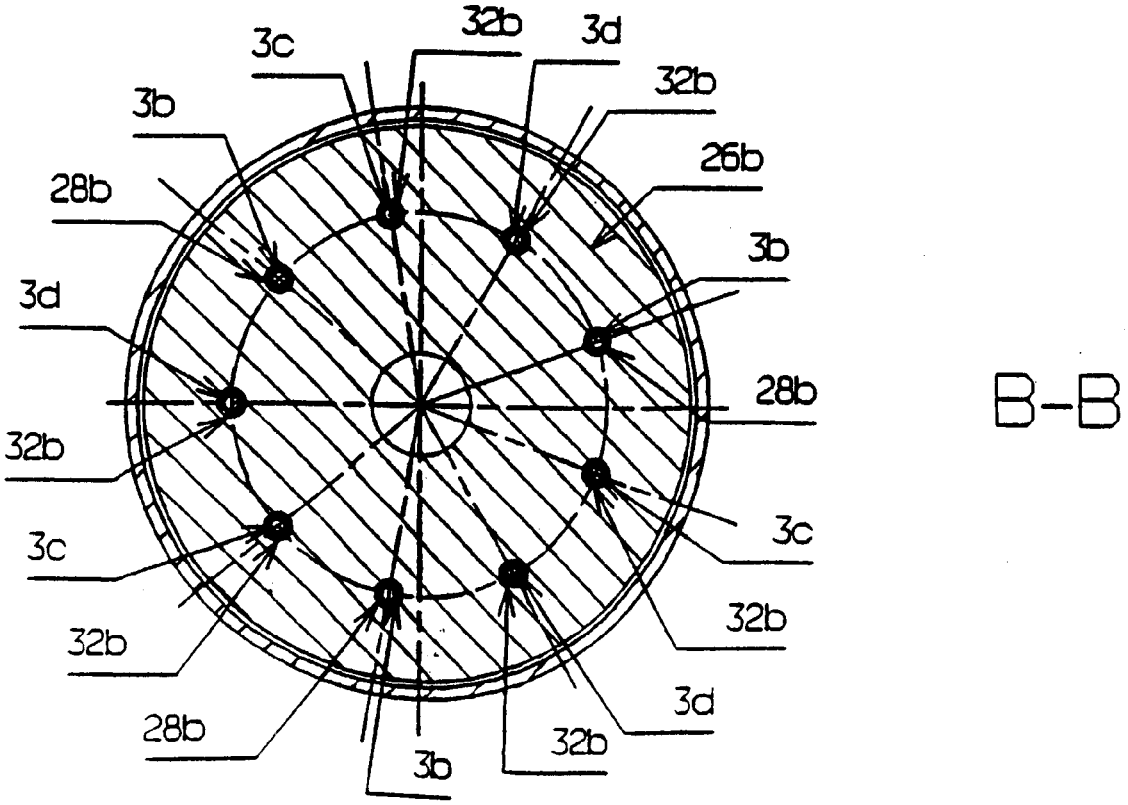

So as to allow the different diffuser tubes to pass through the different blocks until reaching their ignition channels, certain agglomerated blocks also incorporate open-ended linking channels 32 whose axes are also parallel to axis 30 of the ammunition 21 (see FIGS. 4, 5 and 6).

Thus, a first intermediate block 26*c* has (in addition to its three closed-ended ignition channels) three linking channels 32*c*, which provide a passage for the diffuser tubes 3*d* intended to ignite the upper block 26*d* (see FIG. 5).

The second intermediate block 26*b* has (in addition to its three closed-ended ignition channels 28*b*) six linking channels 32*b* intended to provide a passage for the diffuser tubes 3*c* and 3*d* intended to ignite the intermediate block 26*c* and the upper block 26*d* (see FIG. 6).

The angular spacing of the different channels can be more clearly seen in the sections of the ammunition 21 shown in FIGS. 4, 5 and 6.

We should also note that each agglomerated block 26*b*, 26*c* and 26*d* has an axial block in a shape corresponding to that of the projectile 24, and notably receiving the fins 34 from the tail piece 33 of the projectile.

Points 38, made of a plastic material, are placed between propellant blocks 26*b* and 26*c* as well as between propellant blocks 26*c* and 26*d*. These points are evenly spaced angularly and allow the different blocks to be angularly joined to prevent any shearing of the diffuser tubes 3 They allow ensure the angular indexing of the blocks allowing the different channels to be aligned and thereby allowing the tubes 3 to be introduced after the blocks have been stacked.

Three points 38, for example, will be provided between each block.

Similarly, three other points 39 are placed between the rear block 26*a* and the intermediate block 26*b*.

This ammunition is assembled as follows:

First of all the upper block 26*d* in fastened onto the projectile 24, the indexing points 38 are then set into position on it.

Intermediate blocks 26*c* and 26*b* and then successively positioned onto the projectile, positioning indexing points 38 between them.

Indexing points 39 are then positioned. The case 22 is slid into place around the propellant blocks and is riveted into place on the linking part 25.

The different tubes 3 are then set into place through the channels 28. The tubes have previously been attached to the sleeve 14 of the ignition means.

The bowl 40 is mounted on the base 23 and then the rear propellant block 26*a* is stuck into the bowl 40 (using spots of silicon adhesive). Reference may be made to patent FR2799831 that describes such a mode to fasten a bowl onto a base.

Lastly, the igniter is screwed onto the sleeve 14 which is capped by the base that will be fastened to the igniter, for example by an axial nut (see patent FR299831) and then fastened by rivets 41 to the case 22.

Different variants are possible without departing from the scope of the invention.

It is thus possible for a charge to be made that incorporates three agglomerated propellant blocks but in which the ignition is carried out via a single intermediate block 26*c*. The diffuser tubes will, in this case, pass through block 26*b* and only the intermediate block 26*c* will be fitted with ignition channels 28.

The number and angular spacing of the diffuser tubes may also be varied. It would thus be possible for the depth of the ignition channels to be varied by providing, for example, several ignition channels of different depths for any given block.

What is claimed is:

1. An ignition device for igniting a propellant charge, comprising:

a propellant charge;

at least one ignition means for generating a plasma in the propellant charge therein, each said ignition means comprising a plurality of diffuser tubes extending through part of said propellant charge, each of said plurality of diffuser tubes for guiding a flame generated by said ignition means to one of a plurality of receiver zones of said propellant charge, wherein said ignition means comprises a generator for generating 1 kilojoule to 1 megajoule of energy.

2. The ignition device according to claim 1, wherein each diffuser tubs comprises a flexible plastic material.

3. The ignition device according to claim 2, wherein each diffuser tube has a thickness between 0.7 and 1.5 mm.

4. The ignition device according to claim 3, wherein each diffuser tube has an internal diameter between 3 and 6 mm.

5. The ignition device according to claim 1, wherein each diffuser tube further comprises an ignition chamber located at an end thereof located in one of said receiver zones.

6. An ignition device for initiating a piece of ammunition, comprising:

a propellant charge comprising at least one block of agglomerated propellant powder, each block having therein at least one closed-ended ignition channel located in a receiver zone; and at least one ignition means for generating a plasma in each block, comprising:

an igniter; and a plurality of diffuser tubes; wherein each of the diffuser tubes extends through part of said propellant charge, each of said diffuser tubes is located within one of said closed-ended ignition channels and is for guiding a flame generated by said ignition means to one of the receiver zones.

7. The ignition device according to claim 6, wherein said propellant charge comprises at least first and second blocks of agglomerated propellant powder stacked one on another, said first block having an open-ended connecting channel; said second block having at least one closed-ended ignition channel, wherein one of said diffuser tubes extends through said open-ended connecting channel in said first block and is located in a closed-ended ignition channel in said second block.

8. The ignition device according to claim 7, wherein each of said blocks includes three closed-ended ignition channels spaced relative to each other at substantially equal angular intervals and each having one diffuser tube located therein.

9. The ignition device according to claim 8, further comprising a third block, wherein:

said first block is nearest said igniter and said second block is between said first and third blocks, each of said first, second and third blocks includes three closed-ended ignition channels spaced relative to each other at substantially equal angular intervals and having one diffuser tube located therein, said first block also includes six open-ended connecting channels, said second block also includes three open-ended connecting channels, and each open-ended connecting channel has located therethrough one diffuser tube also located in a closed-ended channel in said second and third blocks.

* * * * *